US010393475B2

(12) United States Patent
Keller et al.

(10) Patent No.: US 10,393,475 B2
(45) Date of Patent: Aug. 27, 2019

(54) DEVICES AND METHODS FOR CONVERTING COLLAPSIBLE FIREARM STOCKS

(71) Applicant: Strike Industries Inc., Santa Ana, CA (US)

(72) Inventors: Garrett O'Neill Keller, Santa Ana, CA (US); David Hyung Chin, Huntington Beach, CA (US)

(73) Assignee: Strike Industries, Inc., Santa Ana, CA (US)

( * ) Notice: Subject to any disclaimer, the term of this patent is extended or adjusted under 35 U.S.C. 154(b) by 0 days.

(21) Appl. No.: 16/000,578

(22) Filed: Jun. 5, 2018

(65) Prior Publication Data

US 2018/0347939 A1 Dec. 6, 2018

Related U.S. Application Data

(60) Provisional application No. 62/516,048, filed on Jun. 6, 2017.

(51) Int. Cl.

| | |
|---|---|
| ***F41C 23/00*** | (2006.01) |
| ***F41C 23/14*** | (2006.01) |
| ***F41C 23/20*** | (2006.01) |
| ***F41C 23/04*** | (2006.01) |

(52) U.S. Cl.
CPC ..... *F41C 23/14* (2013.01); *F41C 23/04* (2013.01); *F41C 23/20* (2013.01)

(58) Field of Classification Search
CPC ..... F41C 23/00; F41C 23/04; F41C 23/14
See application file for complete search history.

(56) References Cited

U.S. PATENT DOCUMENTS

| | | | | |
|---|---|---|---|---|
| 10,012,470 | B2 * | 7/2018 | Johnson | F41C 23/14 |
| 2003/0140541 | A1 * | 7/2003 | Kay | F41C 23/22 42/72 |
| 2011/0283584 | A1 * | 11/2011 | Walters | F41C 23/04 42/73 |
| 2015/0176944 | A1 * | 6/2015 | Kupanoff | F41C 23/14 42/73 |
| 2018/0066916 | A1 * | 3/2018 | Olsen | F41C 23/14 |

FOREIGN PATENT DOCUMENTS

| | | | | |
|---|---|---|---|---|
| EP | 2080980 | A2 * | 7/2009 | F41C 23/04 |

* cited by examiner

*Primary Examiner* — Gabriel J. Klein
(74) *Attorney, Agent, or Firm* — Andy M. Han; Han IP PLLC

(57) ABSTRACT

Devices and method for converting collapsible firearm stocks are provided. In one embodiment, a conversion device for converting a stock is provided, the stock comprising a locking pin, configured to slide along a receiver extension having a plurality of position holes and lock into position, the conversion device comprising: a first insert having a first plug configured to insert into a first position hole of the plurality of position holes; a second insert having a second plug configured to insert into a second position hole of the plurality of position holes; wherein inserting the first and second plugs into the first and second position holes, respectively, covers all of the plurality of position holes except for a single position hole for receiving the locking pin of the stock; and wherein the single position hole converts the stock from being collapsible to fixed on the firearm.

18 Claims, 9 Drawing Sheets

DEVICES AND METHODS FOR CONVERTING COLLAPSIBLE FIREARM STOCKS

CROSS-REFERENCE TO RELATED APPLICATION

This application claims priority to provisional application Ser. No. 62/516,048, filed on Jun. 6, 2017, the entire contents of which are hereby incorporated by reference.

FIELD OF THE INVENTION

The present invention generally relates to firearms and more specifically to devices and methods for converting collapsible firearm stocks into fixed stocks.

BACKGROUND

As firearms laws and regulations shift over time, owners of some firearms and firearm accessories can find their products subject to additional and different laws and regulations. Moreover, newly purchased firearms can be subject to heightened regulations if they include certain types of accessories. Such restrictions can subject firearms that have collapsible stocks to heightened regulations or even bans. For instance, some legal jurisdictions have placed restrictions on collapsible stocks such as prohibiting the use of a collapsible stock in a semi-automatic rifle. In contrast, firearms that have fixed stocks can comply with these heightened regulations in some jurisdictions.

SUMMARY

The various embodiments of the present stock converting devices (may also be referred to as "conversion device") have several features, no single one of which is solely responsible for their desirable attributes. Without limiting the scope of the present embodiments, their more prominent features will now be discussed below. After considering this discussion, and particularly after reading the section entitled "Detailed Description," one will understand how the features of the present embodiments provide the advantages described here.

One aspect of the present embodiments includes the realization that, in current collapsible stocks, the collapsible stocks typically function by means of a series of common parts. For example, collapsible stocks often have a lever that, when depressed, adjusts a pin allowing the collapsible stock to fit into various position holes of a receiver extension (may also be referred to as buffer tubes). The receiver extensions may have between four to seven position holes corresponding to different adjustments (i.e., lengths) of the collapsible stock. Typically, the receiver extension may be joined to a lower receiver of a firearm and the collapsible stock is then coupled to the receiver extension. By depressing the lever and moving the collapsible stock along the receiver extension, the pin may insert into one of the several position holes. The lever thereby allows adjustment of the collapsible stock along the receiver extension. Previous techniques for converting collapsible stocks into fixed stocks involved drilling holes in the collapsible stock and using additional pins to fix the collapsible stock in place. The drilling and pinning process can be destructive to stocks and cause permanent damage and/or alteration to the stocks. Therefore, there is a need in the firearms industry for devices and methods for converting collapsible stocks into fixed stocks without permanent alteration or damage to the stocks.

In a first aspect, a conversion device for converting a stock from being collapsible to fixed on a firearm is provided, the stock comprising a locking pin, wherein the stock is configured to slide along a receiver extension having a plurality of position holes and lock into position using the locking pin, the conversion device comprising: a first insert having a first plug configured to insert into a first position hole of the plurality of position holes of the receiver extension, wherein inserting the first plug into the first position hole covers the first position hole; a second insert having a second plug configured to insert into a second position hole of the plurality of position holes of the receiver extension, wherein inserting the second plug into the second position hole covers the second position hole; wherein inserting the first plug into the first position hole and inserting the second plug into the second position hole covers all of the plurality of position holes except for a single position hole for receiving the locking pin of the stock; and wherein the single position hole receiving the locking pin of the stock converts the stock from being collapsible to fixed on the firearm.

In an embodiment of the first aspect, the first position hole is located at a forward-most position of the plurality of position holes of the receiver extension.

In another embodiment of the first aspect, the inserting the first plug into the first position hole covers the first position hole and at least one addition position hole of the plurality of position holes of the receiver extension.

In another embodiment of the first aspect, the second position hole is located at a rearward-most position of the plurality of position holes of the receiver extension.

In another embodiment of the first aspect, the conversion device further comprises a front locking element that prevents the stock from sliding beyond the front locking element.

In another embodiment of the first aspect, the first and second plugs each have a tri-lateral symmetry and a center hollowing.

In another embodiment of the first aspect, the stock further includes a lever for adjusting the locking pin to a plurality of levels.

In another embodiment of the first aspect, the plurality of levels includes a fully undepressed, a partially depressed, and fully depressed.

In another embodiment of the first aspect, the conversion device is a singular unit that may be cut into the first insert and the second insert along at least one cutting groove.

In another embodiment of the first aspect, the conversion device is made using a polymer material.

In a second aspect, a method for converting a stock from being collapsible to fixed on a firearm using a conversion device is provided, the stock comprising a locking pin, wherein the stock is configured to slide along a receiver extension having a plurality of position holes and lock into position using the locking pin, the method comprising: inserting a first plug of a first insert of the conversion device into a first position hole of the plurality of position holes of the receiver extension, wherein inserting the first plug into the first position hole covers the first position hole; inserting a second plug of a second insert of the conversion device into a second position hole of the plurality of position holes of the receiver extension, wherein inserting the second plug into the second position hole covers the second position hole; wherein inserting the first plug into the first position hole and inserting the second plug into the second position hole covers all of the plurality of position holes except for a single position hole; sliding the stock along the receiver extension over the first position hole and the second position hole; and inserting the locking pin into the single position hole thereby converting the stock from being collapsible to fixed on the firearm.

In an embodiment of the second aspect, the first position hole is located at a forward-most position of the plurality of position holes of the receiver extension.

In another embodiment of the second aspect, the inserting the first plug into the first position hole covers the first position hole and at least one addition position hole of the plurality of position holes of the receiver extension.

In another embodiment of the second aspect, the second position hole is located at a rearward-most position of the plurality of position holes of the receiver extension.

In another embodiment of the second aspect, the conversion device further comprises a front locking element that prevents the stock from sliding beyond the front locking element.

In another embodiment of the second aspect, the first and second plugs each have a tri-lateral symmetry and a center hollowing.

In another embodiment of the second aspect, the stock further includes a lever for adjusting the locking pin to a plurality of levels.

In another embodiment of the second aspect, the plurality of levels includes a fully undepressed, a partially depressed, and fully depressed.

In another embodiment of the second aspect, the method further comprises cutting the conversion device along at least one cutting grove into the first insert and the second insert along at least one cutting groove.

In another embodiment of the second aspect, the conversion device is made using a polymer material.

DETAILED DESCRIPTION OF THE DRAWINGS

Figure 1:
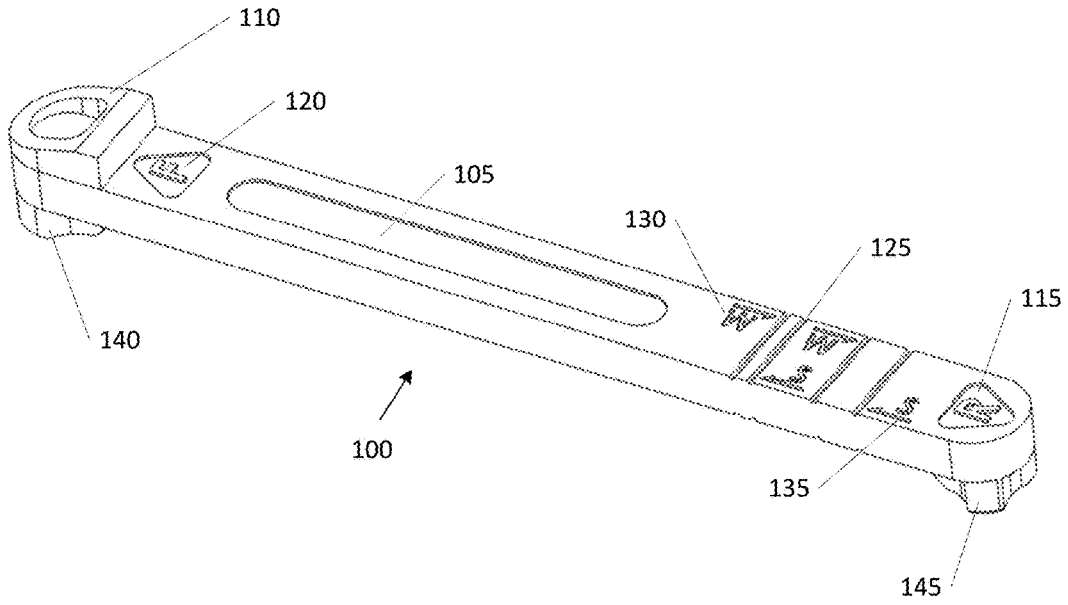
FIG. 1 is a bottom perspective view of a stock converting device in accordance with an embodiment of the invention.

Turning now to the drawings, stock converting devices in accordance with embodiments of the invention are disclosed. In many embodiments of the invention, the stock converting device may be made using various high strength polymer materials including (but not limited to) plastics. In other embodiments, the stock converting device may be made using any suitable material including (but not limited to) metal and/or wood based materials. In several embodiments, the stock converting device may be fitted to a receiver extension and collapsible stock in a manner that removes the capability of an otherwise collapsible stock to be collapsed, as further described below. Thereby, the stock converting device may effectively convert collapsible stocks into fixed stocks without permanently modifying host firearms or host stocks. An exemplary embodiment of the invention features a stock converting device that is configured into a first insert and a second insert and fitted to a receiver extension, such as that on a M4 style semi-automatic rifle. Once fit to a receiver extension, the stock converting device may leave a single position hole open for insertion of a pin of the collapsible stock and further prevent the stock from collapsing inward towards the barrel of the firearm using a forward stopping element, as further described below.

In various embodiments, stock converting devices may be scored with at least one cutting groove to facilitate ease of trimming to fit. The cutting grooves can be marked to indicate lines which can be cut so that the stock converting device is configured into a first insert and a second insert that fits in various brands of receiver extensions such as (but not limited to) a Strike Industries® Viper MOD-1 Stock. Stock converting devices of several embodiments can further include a front locking element on the leading edge of the first insert to prevent the stock from moving and collapsing inward. Stock converting devices can also include various plugs that fit into particular position holes of receiver extensions.

When cut along particular cut grooves and inserted as two pieces (e.g., first insert and second insert) between a receiver extension and a collapsible stock, the first insert and second insert serve to fix the stock in place and prevent adjustment. In many embodiments, the first insert may include a first plug and the second insert may include a second plug that insert into particular position holes of the receiver extension by which the locking mechanism of a collapsible stock engages to hold a position. By inserting the first and second plug into particular position holes, the first and second inserts may cover the position holes such that only a single position hole is left open. In various embodiments, although each of the first plug and the second plug insert and cover a single position hole, the first insert and the second insert cover more than the two position holes covered by the first and second plugs. Once the first insert and second insert are inserted, the pin of the collapsible stock may only insert into the single open position hole. In many embodiments, the single open position hole is located between the position hole(s) covered by the first insert and the position hole(s) covered by the second insert. In addition, the first insert may include a front locking element that prevents the stock from collapsing inward. The resulting configuration of receiver extension, stock, and stock converting device fix stock in place and thereby result in a fixed stock.

As described above and herein, one aspect of the present embodiments includes the realization that current collapsible stocks other than the present embodiments do not allow a firearm owner to covert a collapsible stock into a fixed stock without permanently altering or damaging the stock. Further, previous techniques involved drilling and destructive modification of collapsible stocks with specialized tools and knowledge of precise locations on stocks for conversion into fixed stocks. Embodiments of the invention provide a firmly fixed stock without destructive modification. Some embodiments can further be utilized in circumstances where a receiver extension is not provided on a firearm. Various embodiments provide for longer or shorter stock converting devices that may be utilized in receiver extensions of differing sizes and with differing numbers of position holes without departing from the spirit of the invention. Stock converting devices having such advantages in accordance with embodiments of the invention are described further below.

Stock Converting Devices

Stock converting devices in accordance with embodiments of the invention allow for converting of collapsible stocks into fixed stocks with minimal tooling and no destructive modifications to the collapsible stocks. Once fixed, the stocks will not adjust from position to position while remaining removable from the firearm. A bottom perspective view of a stock converting device 100 in accordance with an embodiment of the invention is illustrated in FIG. 1. As shown, the stock converting device 100 may be a polymer body with several sub-components. In many embodiments, the stock converting device 100 is itself made of a strong polymer. Various embodiments may utilize other materials including (but not limited to) plastics, polymers, metals, and/or wood materials. Moreover, different embodiments of stock converting devices may be different lengths and/or widths in order to function with various makes, models, and brands of collapsible stocks and/or receiver extensions. The stock converting device 100 may have a first face that includes a shallow recess well 105 to assist in gripping of the stock converting device 100. The stock converting device 100 may also include a front locking element 110 that may prevent the stock from collapsing inward and assisting in holding the stock in a fixed position, as further described below.

The stock converting device 100 may further include a rear side marker 115 and a front side marker 120 that may assist in orientation and installation of the stock converting device 100. In various embodiments, the rear side marker 115 may correspond to a position that is further from the barrel of the firearm. Whereas, the front side marker 120 may correspond to a position that is closer to the barrel of the firearm.

The stock converting device 100 may include several cutting grooves 125. Stock converting device 100 may include four cutting grooves 125, but different embodiments may have varying numbers of cutting grooves 125. In various embodiments, the cutting grooves 125 may correspond to locations that, when cut, will split the stock converting device 100 into a first insert and a second insert that fit into particular brands, makes, and models of receiver extensions and/or collapsible stocks. While the cutting grooves 125 provide suggested cutting lines which facilitate fixing certain brands of stocks at certain positions, stock converting devices of many embodiments may be modified to lock out other positions of collapsible stocks as required by the user. For instance, the stock converting device 100 could be cut further forwards on the polymer body at an unmarked, grooveless location such that the single uncovered position hole would be further forward on the receiver extension.

In some embodiments, the stock converting device 100 may further include brand markers such as (but not limited to) a M brand marker 130 and S brand marker 135. The brand markers may include arrows pointing to certain cutting grooves. If both cutting grooves that are pointed to by S brand markers 135 are cut, then the resulting three pieces of the stock converting device 100 will include two end pieces (the first insert having a first plug 140 and second insert having a second plug 145) that will fit into a Strike Industries® form factor receiver extension. Other embodiments may include different brand markers and associated cutting grooves as necessary to fit different makes, models, and shapes of collapsible stocks.

The stock converting device 100, when cut, blocks movement of collapsible stocks by inserting the first plug 140 and the second plug 145 into particular position holes in a receiver extension. In some embodiments, the first plug 140 may be placed on the forward end (e.g., closer to the barrel of the firearm) of the receiver extension while the second plug 145 may be placed on the rearward end (e.g., further away from the barrel of the firearm) of the receiver extension. Alternative embodiments of the invention may include different shaped inserts and/or inserts designed to fit into different position holes of receiver extensions. Specifically, multiple embodiments have dimensions so that they fit into receiver extensions with different numbers of position holes (such as between 4-10 position holes). Having discussed a bottom perspective view of stock converting device 100, a further illustration will be discussed from a top perspective view of stock converting device 100.

Figure 2:
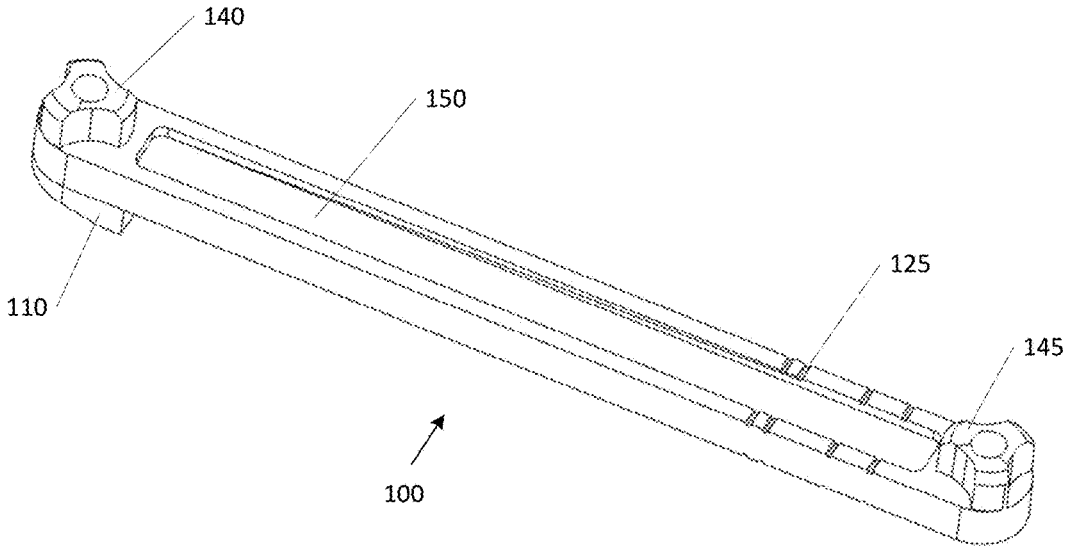
FIG. 2 is top perspective view of a stock converting device in accordance with an embodiment of the invention

A top perspective view of stock converting device 100 in accordance with an embodiment of the invention is illustrated in FIG. 2. In many embodiments, the stock converting device 100 may have a second face that is opposite to the first face, that includes a shallow recess well 150 to assist in gripping of the stock converting device 100. As illustrated, the stock converting device 100 may include the previously discussed front locking element 110, cutting grooves 125, second plug 145, and first plug 140. Cutting grooves 125 may appear on both the second face (as illustrated) and first face (as illustrated in FIG. 1) of the stock converting device 100. In various embodiments, the second plug 145 and the first plug 140 may have tri-lateral symmetry and a hollowing down the center to reduce weight and material use. Other embodiments may have different shaped plugs as necessary to fit into varying makes, models, and brands of extension receivers. Some embodiments may include different quantities and/or placements of the plugs. For instance, several embodiments of the stock converting device 100 may include more than two plugs that insert into position holes of the receiver extension.

Stock converting device 100 of FIG. 1 and FIG. 2 is but one exemplary embodiment of the invention. Different embodiments of the invention can depart from the exemplary embodiments shown in the figures and remain within the spirit of the invention. For instance, different shapes of the sub-components of a stock converting device can be utilized, such as (but not limited to) a filled-in front locking element, plugs, and/or depressions. In addition, circular, square, and/or depressed shaped plugs may be utilized without departing from the invention. Furthermore, varying embodiments can utilize different brand markings, colors, and/or cut lines shapes and placements. In addition, yet still other embodiments of the invention can convert collapsible stocks to fixed stocks for firearms beyond just AR (ArmaLite) and AK (Automatic Kalashnikov) pattern rifles. These yet still other embodiments can be utilized to convert collapsible stocks to fixed stocks in rifles such as (but not limited to) Beretta rifles (ARX), Fabrique National rifles (SCAR), Sig rifles (SIG516), Heckler & Koch (HK416), Galil (ACE), etc. Some embodiments of the invention may omit combinations of sub-components of the stock converting device 100. In several embodiments, at least one of the front side marker, rear side marker, shallow recess well, and brand markers may be omitted. Having discussed stock converting devices, the following discussion will detail background information on receiver extensions and collapsible stocks that can be converted to fixed stocks using stock converting devices in accordance with embodiments of the invention.

Receiver Extensions and Collapsible Stocks

Figure 3:
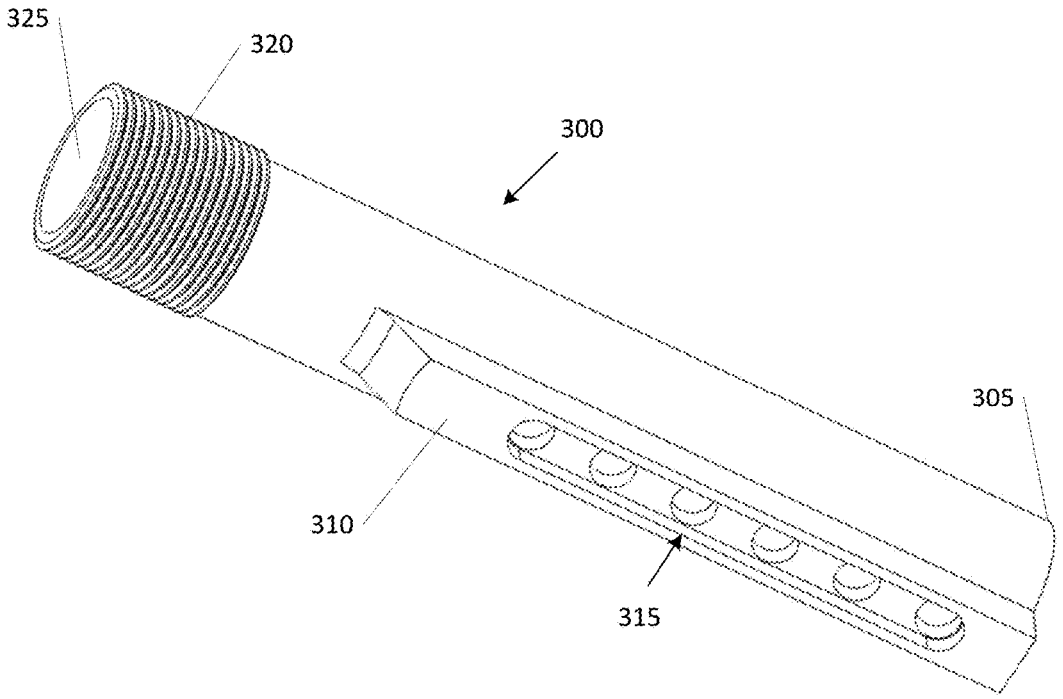
FIG. 3 is a schematic diagram illustrating an exemplary receiver extension that is compatible with an embodiment of the invention.

A schematic diagram illustrating an exemplary receiver extension is illustrated in FIG. 3. The receiver extension 300 is shown from its bottom perspective to reveal a platform 310 and position holes 315. In various embodiments, a receiver threading 320 may serve to attach the receiver extension 300 to a firearm. The connection point between a firearm and receiver extension 300 can be shown in receiver tube 325. Receiver extensions are typically hollow to allow the receiver extension 300 to receive the operating components during the cycling of the firearm. Receiver extensions can have varying numbers of position holes 315 corresponding to different adjustment positions for a collapsible stock. Many embodiments of the invention allow for covering all but one of the position holes 315, leaving a single open position hole 315, and thereby preventing adjustment of the stock. The receiver extension 300 may also include an extension rear end 305 that starts the mating of the receiver extension 300 with stocks of various makes and models.

Figure 4:
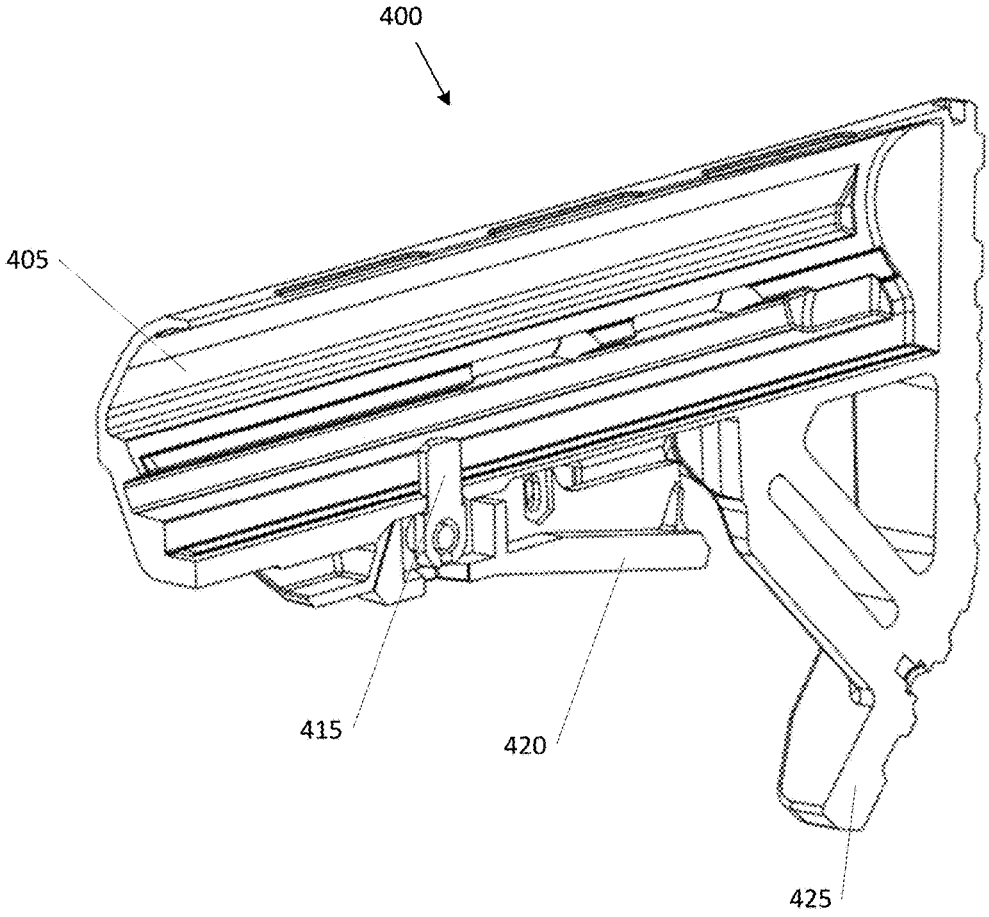
FIG. 4 is a schematic diagram illustrating an exemplary collapsible stock that is compatible with an embodiment of the invention.

A schematic diagram illustrating an exemplary collapsible stock is illustrated in FIG. 4. The collapsible stock 400 is shown in a cut-away drawing from a side perspective to reveal internal components. The collapsible stock 400 may receive a receiver extension via a cavity 405. Further, the collapsible stock 400 may include a stock end 425, which may also be referred to as a buttplate. In many embodiments, the collapsible stock 400 further includes a pin 415 that may be inserted into a position hole of a receiver extension. The collapsible stock 400 may also have a lever 420 that when depressed adjusts the pin 415. In various embodiments, the lever 420 has several levels of depression. A first level is fully undepressed. When fully undepressed, the pin will sit inside of a position hole of a receiver extension. A second level is partially depressed. When partially depressed, the pin 415 may move partially out of the position hole and be able to be moved forwards and backwards over the position holes of the receiver extension. However, at the second level, the collapsible stock 400 will not slide off and disengage from the receiver extension. In many embodiments, once the stock converting device is inserted into the receiver extension, the functionality of the second level of depression that allows the pin 415 to move about the various position holes may be impeded as there is typically only a single open position hole for the pin 415 to engage. In other words, various embodiments of the invention provide for a stock converting device that covers all but one of the position holes and thus prevents forwards and backwards movement over the holes at the second level of depression. A third level is fully depressed. When fully depressed, the pin 415 is sufficiently pulled downwards away from the cavity 405 such that the collapsible stock can be pulled off and disengaged from a receiver extension. In various embodiments, the lever 420 should also be fully depressed for pulling on and engaging a receiver extension.

Figure 5:
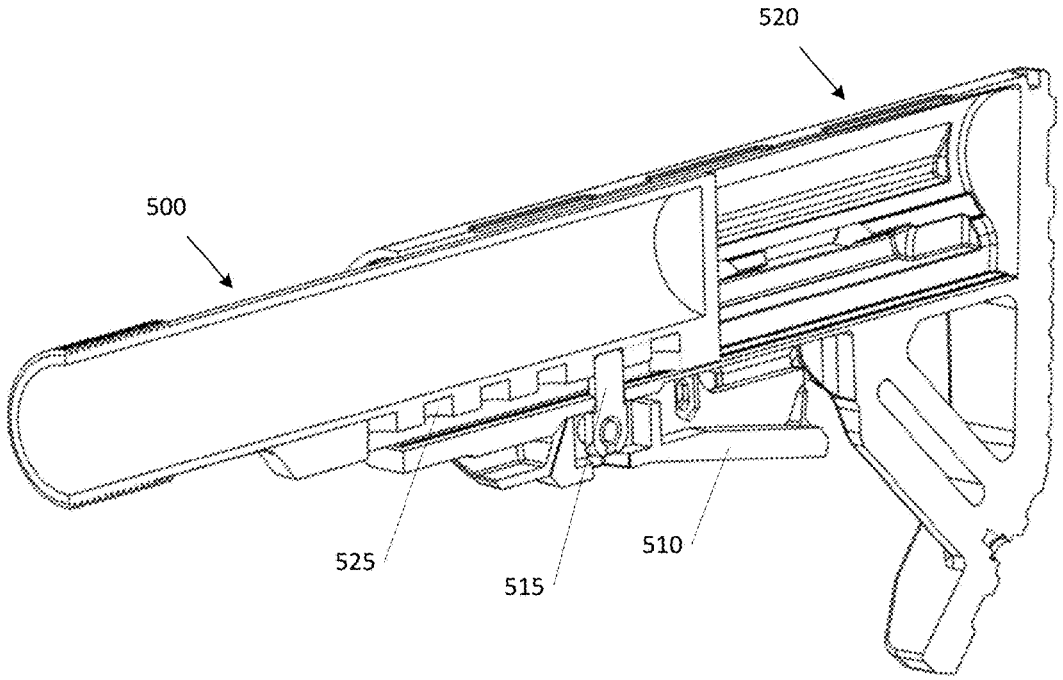
FIG. 5 is a schematic diagram illustrating an exemplary receiver extension coupled to an exemplary collapsible stock.

A schematic diagram illustrating an exemplary collapsible stock coupled to a receiver extension is illustrated in FIG. 5. As shown, the receiver extension 500 may be inserted into the collapsible stock 520 at varying lengths by depressing the lever 510 and allowing the movement of a pin 515 to varying position holes. Empty position holes 525 are shown. By depressing the lever 510 and moving the collapsible stock 520 along the receiver extension 500, the pin 515 may insert into one of several open position holes. The lever 510 thereby allows adjustment of the collapsible stock 520 along the receiver extension 500. As discussed above, collapsible stocks are subject to heightened regulations in some districts and must be fixed to comply with certain laws. Embodiments of the invention provide for a stock converting device that fits between the shown collapsible stock and receiver extension. Processes for installing stock converting devices in accordance with embodiments of the invention will be discussed below.

Processes for Installing Stock Converting Devices

Figure 6:
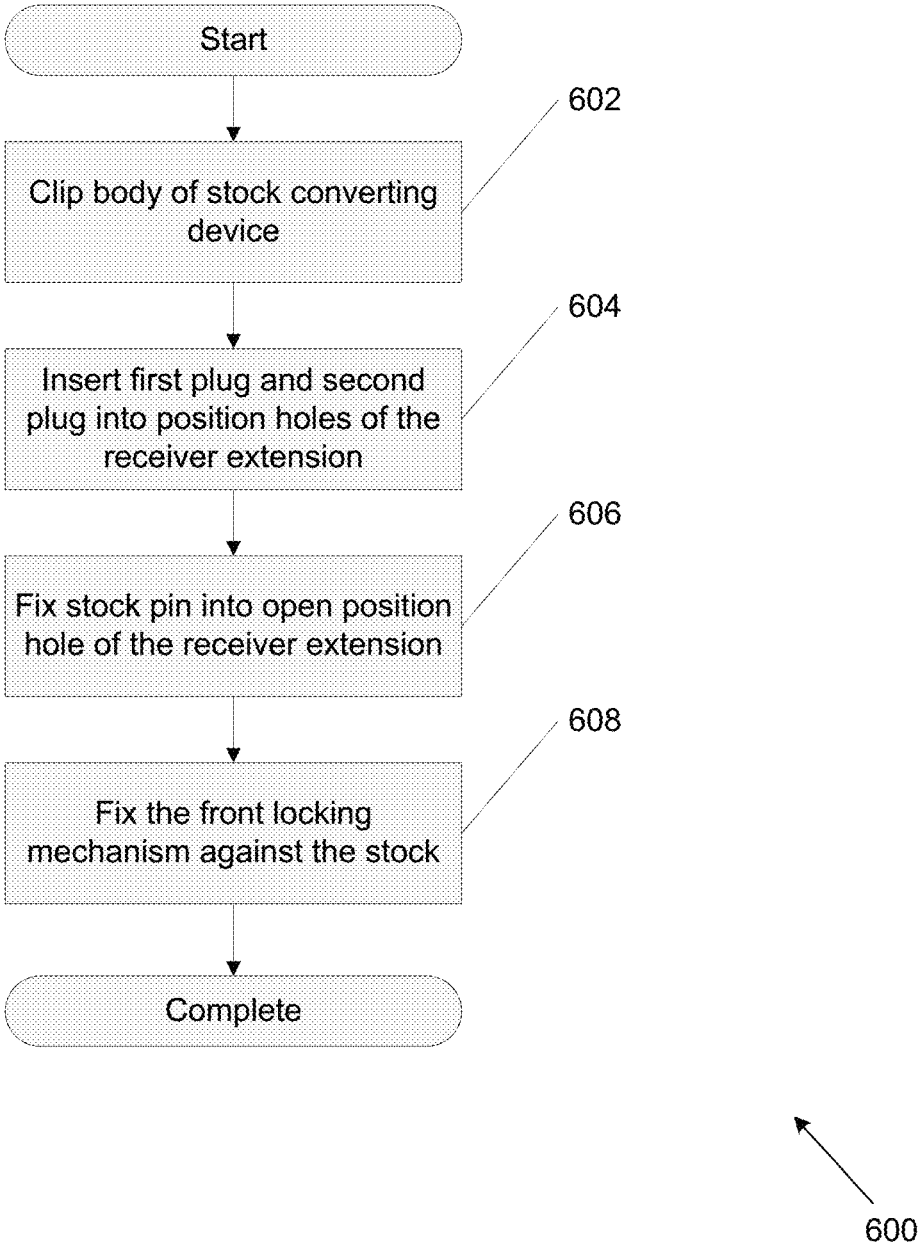
FIG. 6 is a flowchart illustrating a process for converting a collapsible stock into a fixed stock using a stock converting device in accordance with an embodiment of the invention.

Stock converting devices in accordance with embodiments of the invention provide an easy to install and non-destructive method for converting collapsible stocks into fixed stocks. A flowchart illustrating a process 600 for converting a collapsible stock into a fixed stock using a stock converting device in accordance with an embodiment of the invention is shown in FIG. 6. To start, a firearm, a collapsible stock, a receiver extension, and a stock converting device can be gathered and arranged. To install the stock converting device, typically the receiver extension and the collapsible stock will be arranged for installation.

The process 600 may include clipping (602) (may also be referred to as cutting) the body of a stock converting device along at least one cutting groove. Typically, two cuts may be made along brand marked cutting grooves, where the brand marker will match the brand of the previously arranged collapsible stock. After cutting along two grooves, three parts will result from the clipped body: a first insert, a central bit, and a second insert. In many embodiments, the first insert may include a forward stopping element, a forward mark, and a first plug to be inserted into the forward-most position hole of the receiver extension. The central bit can usually be discarded without affecting the fixing of the collapsible stock. In many embodiments, the second insert will include a rearward mark and a second plug to be inserted into the rearward-most position hole of the receiver extension.

The process 600 may include inserting (604) the first insert having the first plug and the second insert having the second plug into the receiver extension in accordance with the forward and rearward marks. In various embodiments, the first plug may be inserted into the forward-most position hole of the receiver extension but the first insert will cover more position holes of the receiver extension beyond the forward-most position hole. In addition, the second plug may be inserted into the rearward-most position hole of the receiver extension but, unlike the first insert, the second insert may only cover the rearward-most position hole of the receiver extension. In some embodiments, the second plug may be inserted into the rearward-most position hole of the receiver extension but the second insert will cover more position holes of the receiver extension beyond the rearward-most position hole. In such embodiments, the first plug may be inserted into the forward-most position hole of the receiver extension but, unlike the second insert, the first insert may only cover the forward-most position hole of the receiver extension. After insertion of the first and second plugs into the receiver extension, one position hole typically remains uncovered (e.g., open) while the remainder of the position holes will be covered by the first and second inserts.

The process 600 may further include fixing (606) the stock pin of the collapsible stock into the open position hole of the receiver extension. This can be accomplished by sliding the collapsible stock over the receiver extension with the lever fully depressed or partially depressed as described above. Optionally, the receiver extension can be installed onto the firearm prior to fixing of the stock pin and stock to the receiver extension. Once in place, the stock pin will be unable to be adjusted to other position holes due to the stock converting device being in place.

The process 600 may also include fixing (608) a front locking element against the stock to prevent the stock from collapsing inward toward the barrel of the firearm. Fixing the front locking element and fixing the stock pin into the receiver extension can be performed in any order and/or simultaneously. Once fixed, the stock will no longer adjust when the lever is partially depressed as the stock converting device has covered all but one position hole and further holds the stock in place with the front locking element. To remove the stock from the receiver extension completely, the lever of the stock may be fully depressed to pull the stock off the receiver extension, as described above. Having discussed a process for installing stock converting devices in accordance with an embodiment of the invention, the following discussion will visually demonstrate the installation process using a series of illustrations.

Example Installation of Stock Converting Devices

Figure 7:
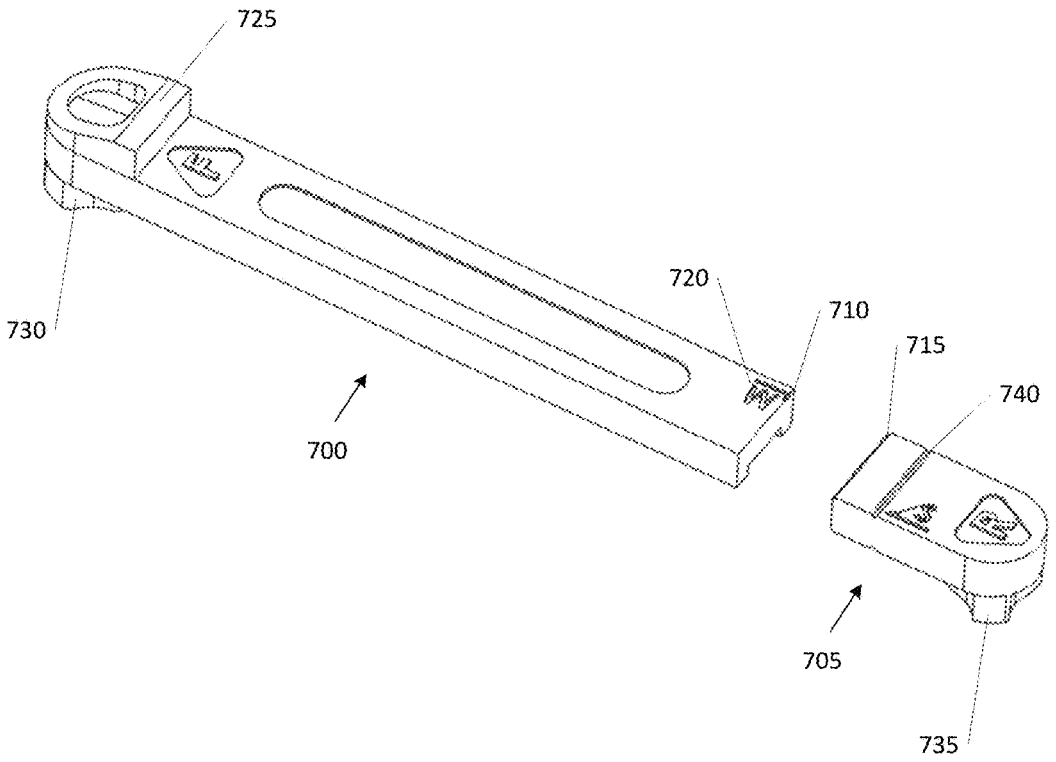
FIG. 7 is a schematic diagram of a stock converting device that has been configured into first and second inserts in accordance with an embodiment of the invention.
Figure 8:
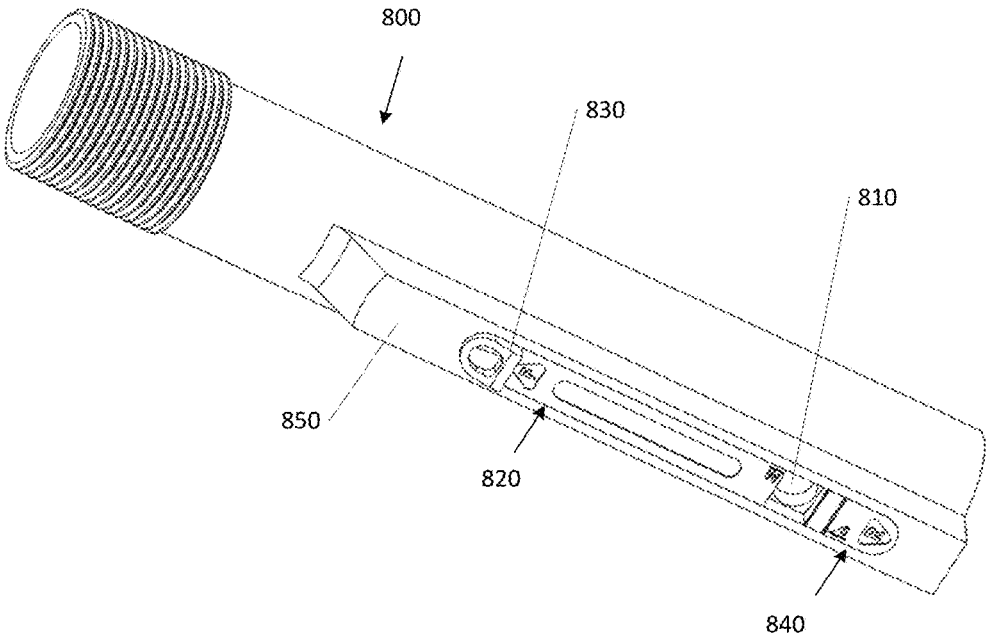
FIG. 8 is a schematic diagram of a stock converting device that has been inserted into a receiver extension in accordance with an embodiment of the invention.
Figure 9:
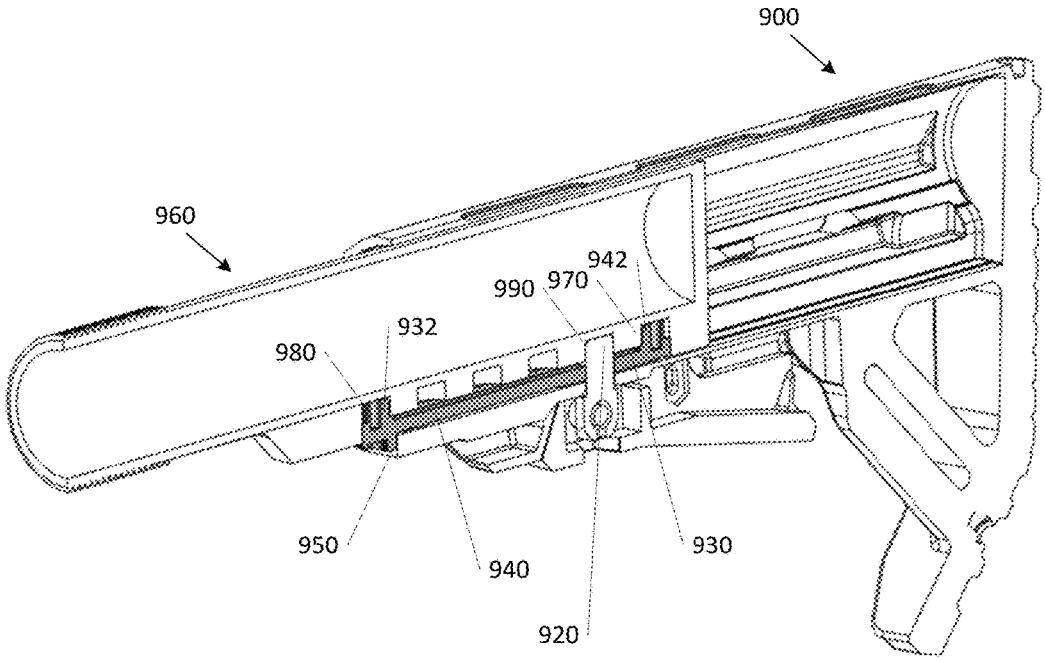
FIG. 9 is a schematic diagram of a collapsible stock converted into a fixed stock using a stock converting device in accordance with an embodiment of the invention.

FIG. 7, FIG. 8, and FIG. 9 provide visual examples of converting a collapsible stock into a fixed stock utilizing stock converting devices in accordance with embodiments of the invention. These visual examples correspond to other processes in accordance with embodiments of the invention that have been described herein. The following figures will demonstrate a stock converting device that has been cut along indicated cutting grooves to yield two stock converting device pieces (e.g., a first insert having a first plug and a second insert having a second plug), insertion of the first and second inserts into a receiver extension, and inserting a pin of the stock in an open position hole of the receiver extension.

A schematic diagram illustrating an example stock converting device that has been cut into first and second inserts in accordance with an embodiment of the invention is illustrated in FIG. 7. As illustrated, the stock converting device has been clipped into two parts, a first insert 700 and a second insert 705. The center bit has been removed at cutting groove 710 and cutting groove 715 and discarded. The resulting gap between first insert 700 and second insert 705 corresponds to where a pin of a stock will be inserted. In this example, the grooves have been cut at lines corresponding to brand 'M' 720 and cutting groove 740 with brand 'S' marked remains uncut.

As described above, the first insert 700 may include a front locking element 725 and a first plug 730. The first insert 700 may be inserted into a receiver extension by inserting the first plug 730 into the front most position hole of a receiver extension. Likewise, the second insert 705 may be inserted into the receiver extension by inserting the second plug 735 into the rear most position hole of a receiver extension.

A schematic diagram illustrating an example stock converting device inserted into a receiver extension in accordance with an embodiment of the invention is illustrated in FIG. 8. The stock converting device shown in FIG. 8 has already been cut into a first insert and a second insert and the first and second inserts have been inserted into the illustrated receiver extension, as described above. As shown, first insert 820 and second insert 840 have been inserted into receiver extension 800 leaving a single position hole 810 open. However, the other position holes of receiver extension 800 have been covered by the first insert 820 and the second insert 840. In addition, a front locking element 830 rise above or extend beyond the highest point of a platform 850 of the receiver extension 800 thereby preventing a stock from collapsing further inward towards the barrel of the firearm.

A schematic diagram illustrating a collapsible stock converted into a fixed stock using a stock converting device in accordance with an embodiment of the invention is illustrated in FIG. 9. The stock converting device can be seen placed between a receiver extension 960 and a stock 900. The stock converting device may comprise a first insert 940 and a second insert 930 which are darkened in the illustration. The first insert 940 may be inserted using a first plug 932 placed in the forward-most position hole 980 of the receiver extension 960. The second insert 930 may be inserted using a second plug 942 placed in the rearward-most position hole 970 of the receiver extension 960. As described above, once the first and second inserts 940, 930 are inserted into the receiver extension 960, a single position hole 990 may remain open.

The stock 900 may include a pin 920 that inserts into the open position hole 990 thereby converting the collapsible stock into a fixed stock. In addition, the stock converting device may also include a front locking element 950 that prevents the stock 900 from further collapsing inward towards the barrel of the firearm. The stock 900 is no longer capable of adjustment to the other position holes of the receiver extension 960 and thus is not collapsible. No drills, pins, glues, or cuts are applied to either of the receiver extension 960 or the stock 900. Advantageously, the receiver extension 960 and the stock 900 remain non-destructively altered and conversion from a collapsible to a fixed stock is accomplished.

The examples shown in FIG. 7, FIG. 8, and FIG. 9 are illustrative examples of several embodiments of the invention. Further embodiments of the invention include stock converting devices with polymer bodies of varying form factors to accommodate different makes, models, and brands of receiver extensions and collapsible stocks. Alternative embodiments include longer, shorter, thinner, and/or shallower varieties of stock converting devices without departing from the spirit of the invention. While the above description contains many specific embodiments of the invention, these should not be construed as limitations on the scope of the invention, but rather as an example of one embodiment thereof. It is therefore to be understood that the present invention may be practiced otherwise than specifically described, without departing from the scope and spirit of the present invention. Thus, embodiments of the present invention should be considered in all respects as illustrative and not restrictive.

What is claimed is:

1. A conversion device for converting a stock from being collapsible to fixed on a firearm, the stock comprising a locking pin, wherein the stock is configured to slide along a receiver extension having a plurality of position holes and lock into position using the locking pin, the conversion device comprising:

a first insert having a first plug configured to insert into a first position hole of the plurality of position holes of the receiver extension, wherein inserting the first plug into the first position hole covers the first position hole;

a second insert having a second plug configured to insert into a second position hole of the plurality of position holes of the receiver extension, wherein inserting the second plug into the second position hole covers the second position hole;

wherein inserting the first plug into the first position hole and inserting the second plug into the second position hole covers all of the plurality of position holes except for a single position hole for receiving the locking pin of the stock;

wherein the single position hole receiving the locking pin of the stock converts the stock from being collapsible to fixed on the firearm; and wherein the conversion device is a singular unit that may be cut into the first insert and the second insert along at least one cutting groove.

2. The conversion device of claim 1, wherein the first position hole is located at a forward-most position of the plurality of position holes of the receiver extension.

3. The conversion device of claim 2, wherein inserting the first plug into the first position hole covers the first position hole and at least one addition position hole of the plurality of position holes of the receiver extension.

4. The conversion device of claim 2, wherein the second position hole is located at a rearward-most position of the plurality of position holes of the receiver extension.

5. The conversion device of claim 1, the first insert further comprises a protrusion opposite the first plug that prevents the stock from sliding beyond the front locking element.

6. The conversion device of claim 1, wherein the first and second plugs each have a tri-lateral symmetry and a center hollowing.

7. The conversion device of claim 1, wherein the stock further includes a lever for adjusting the locking pin to a plurality of levels.

8. The conversion device of claim 7, wherein the plurality of levels includes a fully undepressed, a partially depressed, and fully depressed.

9. The conversion device of claim 1, wherein the conversion device is made using a polymer material.

10. A method for converting a stock from being collapsible to fixed on a firearm using a conversion device, the stock comprising a locking pin, wherein the stock is configured to slide along a receiver extension having a plurality of position holes and lock into position using the locking pin, the method comprising:

inserting a first plug of a first insert of the conversion device into a first position hole of the plurality of position holes of the receiver extension, wherein inserting the first plug into the first position hole covers the first position hole;

inserting a second plug of a second insert of the conversion device into a second position hole of the plurality of position holes of the receiver extension, wherein inserting the second plug into the second position hole covers the second position hole;

wherein inserting the first plug into the first position hole and inserting the second plug into the second position hole covers all of the plurality of position holes except for a single position hole;

sliding the stock along the receiver extension over the first position hole and the second position hole;

inserting the locking pin into the single position hole thereby converting the stock from being collapsible to fixed on the firearm; and cutting the conversion device along at least one cutting grove into the first insert and the second insert along at least one cutting groove.

11. The method of claim 10, wherein the first position hole is located at a forward-most position of the plurality of position holes of the receiver extension.

12. The method of claim 11, wherein inserting the first plug into the first position hole covers the first position hole and at least one addition position hole of the plurality of position holes of the receiver extension.

13. The method of claim 11, wherein the second position hole is located at a rearward-most position of the plurality of position holes of the receiver extension.

14. The method of claim 10, wherein the first insert further comprises a protrusion opposite the first plug that prevents the stock from sliding beyond the front locking element.

15. The method of claim 10, wherein the first and second plugs each have a tri-lateral symmetry and a center hollowing.

16. The method of claim 10, wherein the stock further includes a lever for adjusting the locking pin to a plurality of levels.

17. The method of claim 16, wherein the plurality of levels includes a fully undepressed, a partially depressed, and fully depressed.

18. The method of claim 1, wherein the conversion device is made using a polymer material.

* * * * *